United States Patent [19]

Brammer et al.

[11] Patent Number: 4,949,787

[45] Date of Patent: Aug. 21, 1990

[54] CASING HANGER SEAL LOCKING MECHANISM

[75] Inventors: Norman Brammer, Scotland, United Kingdom; Philippe C. Nobileau, Ladefense, France

[73] Assignee: Vetco Gray Inc., Houston, Tex.

[21] Appl. No.: 336,012

[22] Filed: Apr. 7, 1989

[51] Int. Cl.[5] ..... E21B 23/00; E21B 33/04

[52] U.S. Cl. ..... 166/208; 166/217; 285/145; 285/140; 285/338

[58] Field of Search ..... 166/208, 217, 135, 181, 166/182, 124, 86, 88; 285/140, 145, 146, 147, 331, 338, 342, 343, 348, 351

[56] References Cited

U.S. PATENT DOCUMENTS

| | | | |
|---|---|---|---|
| 4,521,040 | 6/1985 | Slyker et al. | 285/351 X |
| 4,641,708 | 2/1987 | Wightman | 166/208 |
| 4,665,979 | 5/1987 | Boehm, Jr. | 285/146 X |
| 4,678,209 | 7/1987 | Guice | 285/146 X |
| 4,714,111 | 12/1987 | Brammer | 166/182 |
| 4,742,874 | 5/1988 | Gullion | 166/348 |
| 4,751,965 | 6/1988 | Cassity | 166/182 |
| 4,757,860 | 7/1988 | Reimert | 166/208 |
| 4,791,987 | 12/1988 | Cassity et al. | 166/85 |
| 4,815,170 | 3/1989 | Hyne et al. | 285/351 X |
| 4,832,125 | 5/1989 | Taylor | 166/217 X |

*Primary Examiner*—William P. Neuder

*Attorney, Agent, or Firm*—James E. Bradley

[57] ABSTRACT

A casing hanger seal member has a locking section that will lock the seal member to the casing hanger, to the wellhead, or to both. A set of serrations are formed on the wellhead and also on the casing hanger, across from each other. The seal member has a seal on its lower end that seals below the serrations. A locking section extends upward from the seal section. A locking section has inner and outer walls which are separated by an annular channel. Serrations are formed on the inner and outer walls for engaging the serrations on the wellhead and the casing hanger. An energizing ring locates within the channel, urging the inner and outer walls radially apart form each other to cause engagement of the serrations. The serrations on the inner and outer members have a pitch that is the same as the pitch on the wellhead and casing hanger, divided by a whole number greater than one.

7 Claims, 3 Drawing Sheets

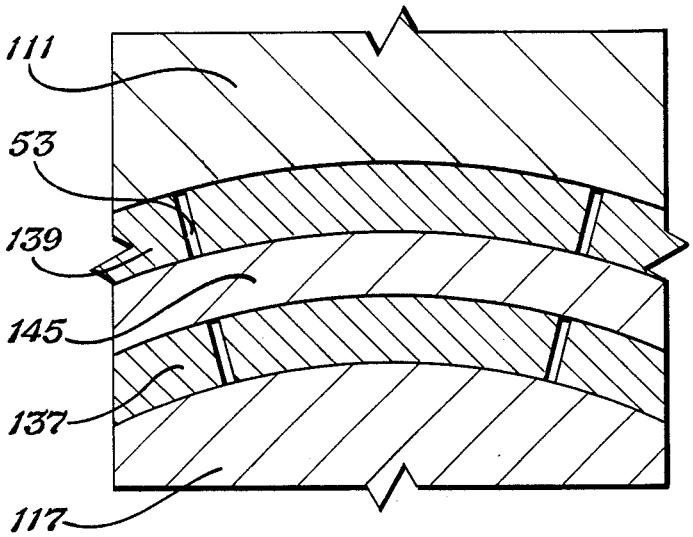
Fig. 3
Fig. 2
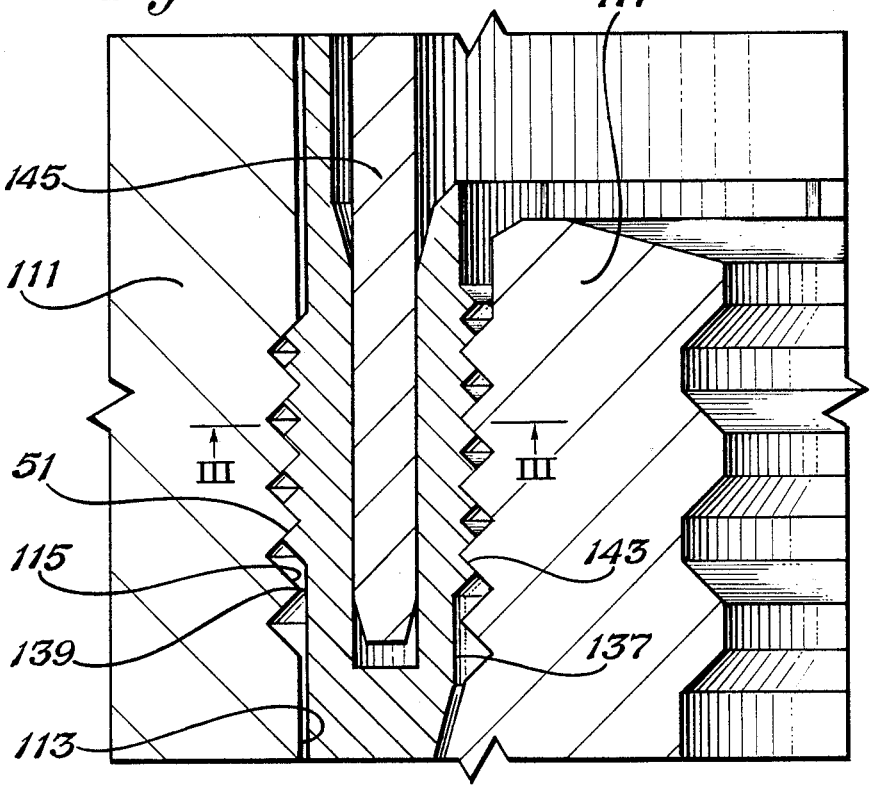

CASING HANGER SEAL LOCKING MECHANISM

BACKGROUND OF THE INVENTION

1. Field of the Invention:

This invention relates in general to subsea wellhead equipment, and in particular to a casing hanger seal member having a mechanism for locking the seal in place.

2. Description of the Prior Art:

In a subsea well of the type concerned herein, a wellhead housing will be located on the sea floor. Casing will extend into the well and be supported at the wellhead housing by a casing hanger. A seal or packoff locates between the casing hanger and the wellhead housing to seal this annulus space.

The casing seal is normally set by compression. The compressive force required can be quite high. One way in which to achieve this high compressive force is by using a nut and thread. Another method utilizes a hydraulic actuated running tool.

While both of these types are satisfactory, there are occasions when the wellhead pressures are not expected to be very high. If the seal did not require a very high compressive force for setting, a simpler running tool could be used. Also, there are occasions when it is desirable to use a seal that could be easily retrieved along with the casing hanger. This occurs particularly when drilling an exploratory well. If the well is abandoned, at least part of the casing may be salvaged. If not abandoned, the seal could be retrieved and replaced with a more permanent seal. Consequently, there is a need for a remotely energized and retrieved seal for a casing hanger that does not require complex running tools and which is easily retrieved.

SUMMARY OF THE INVENTION

In this invention, either the casing hanger, or the wellhead housing, or both, have serrations formed on them. The seal member has a seal section which locates below these serrations and which is sealed by compression. A locking section extends upward from the seal section. This locking section has inner and outer walls which are separated by an annular channel. At least one of the inner and outer walls has serrations also. These serrations are positioned to engage the serrations on the casing hanger or wellhead. One of the sets of serrations has a greater pitch than the other by an even multiple number. This allows adjustment in an axial direction as the seal is set.

An energizing ring is carried by the seal member within the annular channel. The energizing ring will move downward to urge the walls of the locking section apart. This causes the serrations to grip and engage each other.

BRIEF DESCRIPTION OF THE DRAWINGS

FIG. 2 is a partial vertical sectional view illustrating a first alternate embodiment of a casing hanger locking mechanism.

FIG. 3 is a sectional view of the locking mechanism of FIG. 2, taken along the line III—III of FIG. 2.

DESCRIPTION OF THE PREFERRED EMBODIMENTS

Figure 1:
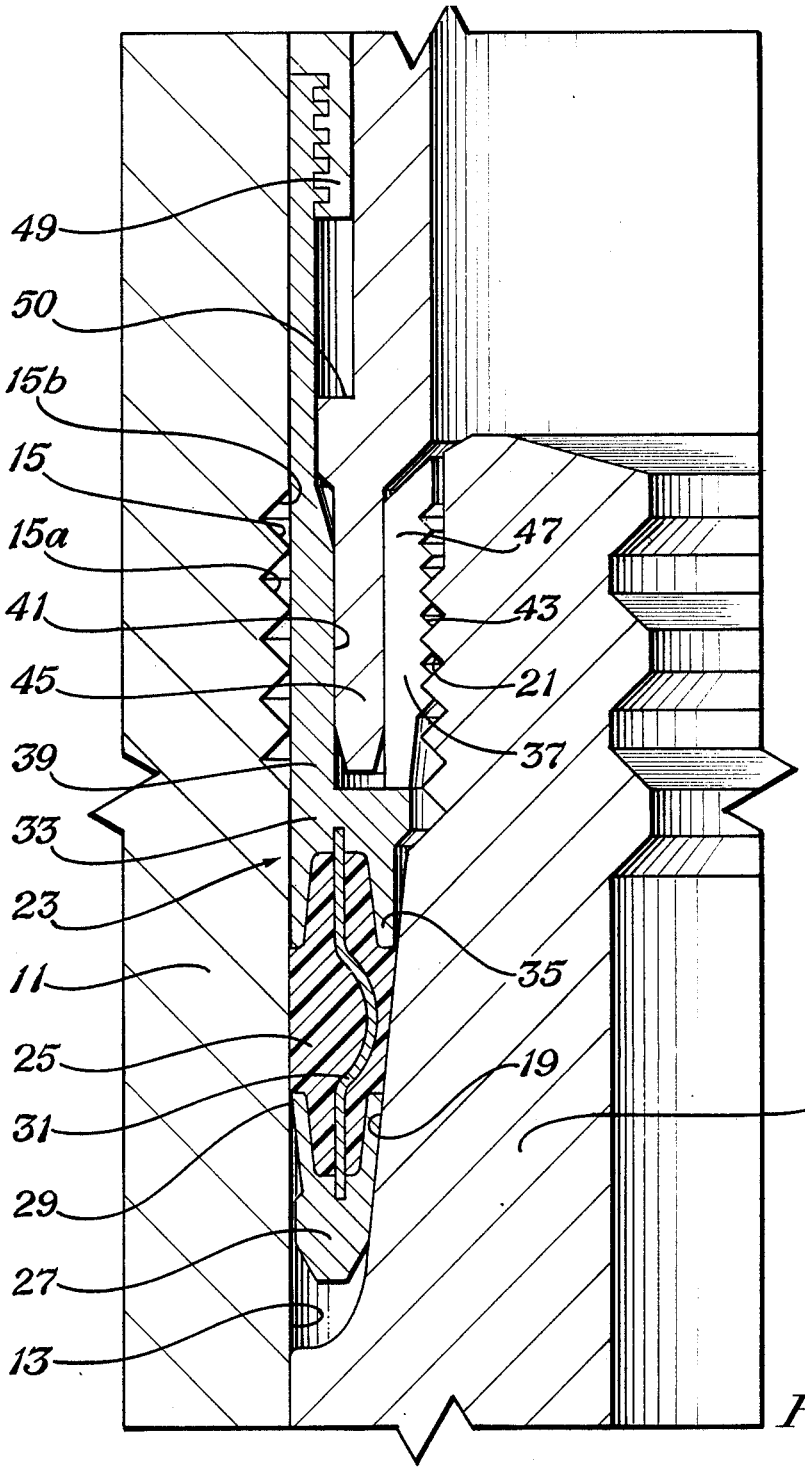
FIG. 1 is a vertical sectional view illustrating a casing hanger seal locking mechanism constructed in accordance with this invention.

Referring to FIG. 1, the subsea well has a wellhead housing 11. Wellhead housing 11 will be located on the sea floor. A bore 13 extends through the wellhead housing 11. Bore 13 has a cylindrical portion containing a plurality of anchoring serrations 15. Serrations 15 each are circumferential grooves. Each of the serrations 15 is in a sawtooth configuration. Each of the serrations 15 has an upward facing flank **15*a* and a downward facing flank 15*b*. The flanks 15*a*, 15*b* intersect each other at a 90 degree angle. The apex or a junction of the flanks 15*a*, 15*b* has an inner diameter that is the same as the inner diameter of the bore 13**.

A casing hanger 17 is conventionally supported within the bore 13 of wellhead housing 11. A string of casing (not shown) extends downward from the casing hanger 17. Casing hanger 17 has a tapered seal surface 19. Seal surface 19 is generally frusto-conical, having a larger diameter at the bottom than at the top. This results in a wedge-shaped annular cavity between the seal surface 19 and the wellhead housing bore 13.

A plurality of anchoring serrations 21 are formed on the exterior of casing hanger 17 above the seal surface 19. The serrations 21 are formed in a cylindrical portion of the casing hanger 17. Serrations 21 are positioned to be generally radially across from the serrations 15. Serrations 21 are identical in size and shape to the serrations 15.

A seal member 23 locates in the annular space between the wellhead housing 11 and the casing hanger 17. Seal member 23 has an elastomeric seal 25 in the preferred embodiment. Elastomeric seal 25 is of a type that is shown in U.S. Pat. No. 4,714,111, Norman Brammer, Dec. 22, 1987. A lower metal ring 27 locates on the bottom of the elastomeric seal 25. Lower ring 27 has a pair of metal sealing lips 29, which will expand outward to form a metal-to-metal seal. A metal linking member 31 is embedded within the seal 25. The linking member 31 will deflect when the seal 25 is set. The linking member 31 extends upward to a metal locking section 33. A pair of sealing lips 35 are located on the lower end of the locking section 33 to form a metal-to-metal seal above the elastomeric seal 25.

Locking section 33 has an inner wall 37 and an outer wall 39. The inner and outer walls 37, 39 are spaced apart from each other radially. This results in an annular channel 41 between the inner and outer walls 37, 39.

A plurality of locking serrations 43 are formed on the inner side of the inner wall 37. Serrations 43 have the same configuration as the serrations 21. That is, each has an upper flank and a lower flank which join each other at a 90 degree angle to form an apex. However, the pitch of the serrations 43 is less than the pitch of the serrations 21. That is, the distance from one apex to the other apex of the serrations 43 is less than the distance from one apex to the other apex of the serrations 21. The pitch of the serrations 43 is equal to the pitch of the serrations 21 divided by a whole number greater than one. The whole number is preferably 2, thus the pitch of the serrations 43 will be one-half that of the serrations 21. Two full serrations 43 will locate between adjacent serrations 21.

The seal member 23 includes an energizing ring 45. The energizing ring 45 has a lower end which is positioned in the channel 41. The energizing ring 45 will move from an upper position where the lower end is spaced at the entrance of channel 41 (not shown) to a lower position which is shown in FIG. 1. The radial thickness of the portion of the energizing ring 45 which enters the channel 41 is bigger than the initial dimension of the channel 41. Consequently, as it enters the channel 41, it forces the inner and outer walls 37, 39 apart.

A plurality of vertical slots 47 are formed in the inner wall 37 to facilitate the inward radial movement of the inner wall 37. Similar slots may also be formed in the outer wall 39. The inner wall 37 must move a distance sufficient so that the serrations 43 will initially clear the serrations 21 as the seal member 23 is lowered into place. A retainer 49 located on the upper end of the outer wall 39 serves to retain the energizing ring 45 with the remaining portions of the seal member 23. When the energizing ring 45 is pulled upward, an external shoulder 50 on the ring 45 will contact the retainer 49, exerting an upward force on the locking section 33.

The deformation of the inner and outer walls 37, 39 by movement of the energizing ring 45 is entirely plastic or elastic. That is, the material strength, dimensions, and slots 47 are selected so that the yield strength of the inner and outer walls 37, 39 will not be exceeded when moved to the energized position. No permanent deformation will take place. Consequently, when the energizing ring 45 is pulled upward, the inner wall 37 will spring outward sufficiently so that the serrations 43 will completely disengage from the serrations 21.

In operation, the casing hanger 17 will be ran in a conventional manner. A running tool (not shown) will lower the seal member 23 without rotation into the space between the casing hanger 17 and the wellhead housing bore 13. The weight on the running tool will force the seal 25 downward, wedging it between the seal surface 19 and the bore 13. A seal will be formed by the elastomeric seal 25 and the sealing lips 29, 35.

Continued downward movement forces the energizing ring 45 into the channel 41. The serrations 43 will engage the serrations 21. The difference in the pitch between the serrations 21 and 43 assures that an upper flank of at least some of the serrations 43 will engage downward flanks on the serrations 21. The difference in pitch also allows for axial variations due to tolerances. The engagement of the serrations 43 with the serrations 21 will lock the seal member 23 to the casing hanger 17. In the embodiment of FIG. 1, the serrations 15 in the wellhead housing bore 13 are not used.

If it is desired to retrieve part of the casing and the casing hanger 17, the same retrieving tool can be used to also pull the seal member 23. An upward pull on the energizing ring 45 will cause it to move upward until shoulder 50 engages the retainer ring 49. At this point, the energizing ring 45 will be located above the channel 41. The inner wall 37 will spring back outward to its initial condition. The serrations 43 will be disengaged from the serrations 21. Continued upward movement or pull on the energizing ring 45 will pull the entire seal member 23 from the space between the casing hanger 17 and the bore 13.

In the embodiment of FIG. 2, serrations 51 are located on the outer wall 139. Serrations 51 are identical to the serrations 143 located on the inner wall 137. The serrations 51 will engage serrations 115 in the bore 113. Serrations 115 are identical to the serrations 15 of the first embodiment shown in FIG. 1. Slots 53 will be formed in the outer wall 139 to facilitate its radial expansion, as illustrated in FIG. 3. The energizing ring 145 urges both the inner and outer walls 137, 139 outward. The inner and outer walls 137, 139 in this embodiment will be locked both to the casing hanger 117 and to the wellhead 111.

Figure 4:
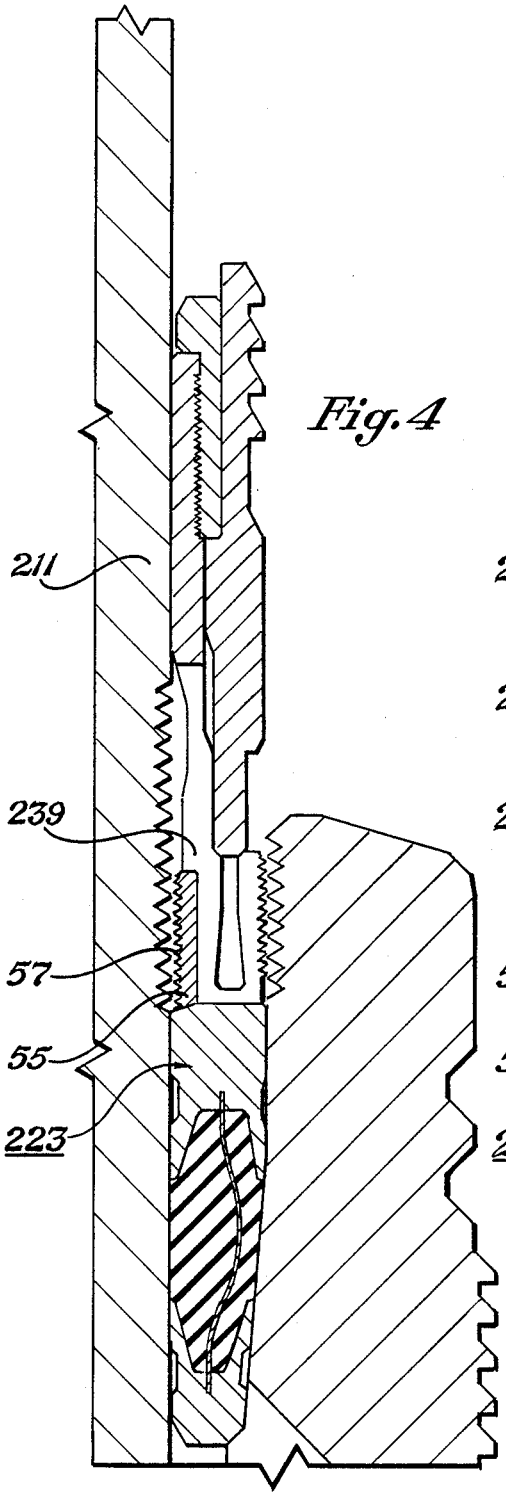
FIG. 4 is a vertical sectional view of a second alternate embodiment of casing hanger locking mechanism, shown prior to being energized.
Figure 5:
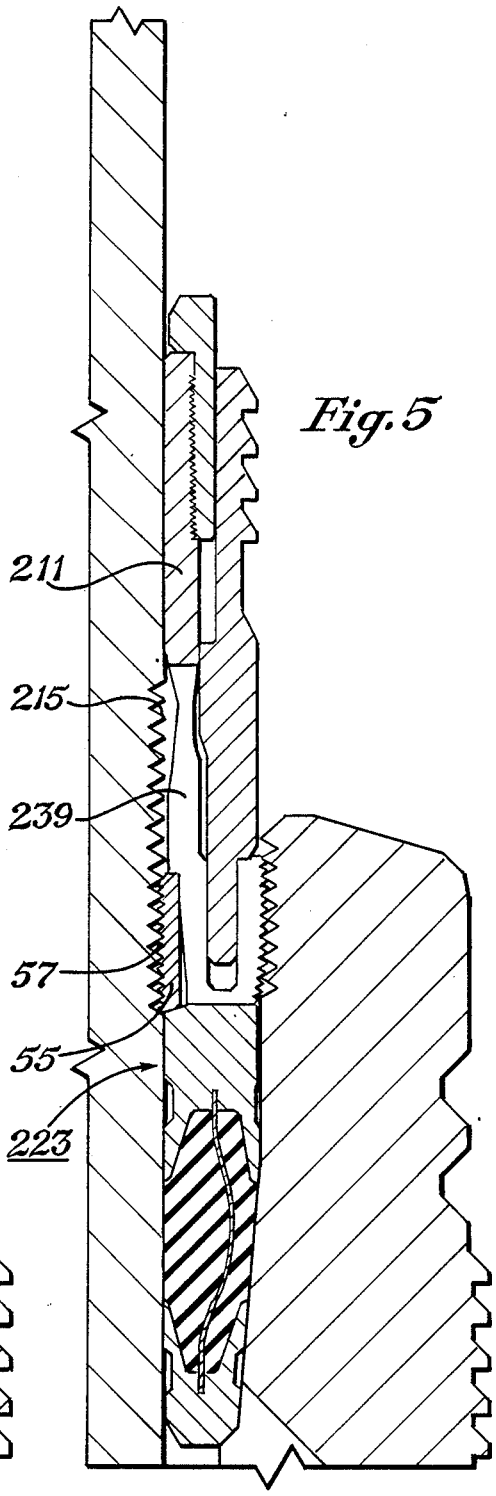
FIG. 5 is a partial vertical sectional view of the locking mechanism of FIG. 4, showing the locking device in an energized state.

In the embodiment of FIGS. 4 and 5, the outer wall 239 has a split ring 55 located on it. The split ring 55 has a plurality of serrations 57. The serrations 57 are identical to the serrations 51 shown in the second embodiment of FIG. 2. Serrations 57 engage serrations 215 in the wellhead housing 211. The split ring 55 may be easily removed at the surface by the operator prior to lowering it into the well. This enables the operator to either lock the seal member 223 to the wellhead housing 211 or not. The seal member 223 otherwise works in the same manner as the seal member 23 of the embodiment of FIG. 1. FIG. 4 shows the seal member 223 prior to being energized, and FIG. 5 shows it in the locked, energized position.

The invention has significant advantages. The serrations in the locking section allow the packoff to be set without the need for extremely high forces and complex running tools. No rotation is required to set the seal member. The elasticity of the inner and outer walls of the seal member allow the seal member to be easily retrieved as well as set. The difference in pitch between the serrations on the inner and outer members' walls and the wellhead casing hanger allow for axial variations when the casing hanger is set.

The operator can select either to lock the seal ring to the wellhead, to lock it to the casing hanger, or lock it to both. In the case of the third embodiment, the operator can easily convert the locking section from one that locks only to a casing hanger to one that locks also to the wellhead housing.

While the invention has been shown in only three of its forms, it should be apparent to those skilled in the art that it is not so limited, but is susceptible to various changes without departing from the scope of the invention.

We claim:

1. In a well having a wellhead housing with a bore therethrough for supporting a casing hanger, the casing hanger having an exterior wall surface spaced inward from an interior wall surface in the bore, an improved means for sealing the wall surfaces between the casing hanger and the wellhead housing, comprising in combination:

a plurality of serrations formed on one of the wall surfaces, each of the serrations having an inclined downward facing flank;

a seal member, having a seal section which is compressed between the wall surfaces below the serrations;

a locking section on the seal member located directly above the seal section, the locking section having inner and outer cylindrical walls radially separated from each other;

a plurality of serrations formed on one of the cylindrical walls of the locking section, each of the serrations on the locking section having an inclined upward facing flank; and means including an energizing ring for downward movement between the walls of the locking section to urge the walls of the locking section apart, causing at least some of the upward facing flanks to engage at least some of the downward facing flanks to lock the seal member in place.

2. In a well having a wellhead housing with a bore therethrough for supporting a casing hanger, the casing hanger having an exterior wall surface spaced inward from an interior wall surface in the bore, an improved means for sealing the wall surfaces between the casing hanger and the wellhead housing, comprising in combination:

a set of serrations having a selected pitch formed on one of the wall surfaces;

a seal member, having a seal section which is compressed between the wall surfaces below the serrations;

a locking section on the seal member extending upward from the seal section, the locking section having inner and outer cylindrical walls radially separated from each other by an annular channel;

a set of serrations having a selected pitch formed on one of the cylindrical walls of the locking section, one of the pitches being greater than the other; and an energizing ring positioned in the channel for downward movement to urge the walls of the locking section apart, causing at least some of the serrations of the locking section to engage at least some of the serrations of the wall surface to lock the seal member in place.

3. In a well having a wellhead housing with a bore therethrough for supporting a casing hanger, the casing hanger having an exterior wall surface spaced inward from an interior wall surface in the bore, an improved means for sealing the wall surfaces between the casing hanger and the wellhead housing, comprising in combination:

a set of anchoring serrations having a saw-tooth shape with a selected pitch formed on one of the wall surfaces;

a seal member, having a seal section which is compressed between the wall surfaces below the anchoring serrations;

a locking section on the seal member extending upward from the seal section, the locking section having inner and outer cylindrical walls radially separated from each other by an annular channel;

a set of locking serrations having a saw-tooth shape of the same configuration as the anchoring serrations and formed on one of the cylindrical walls of the locking section, the locking serrations having a pitch which is equal to the pitch of the anchoring serrations divided by a whole number greater than one; and an energizing ring positioned in the channel for downward movement to urge the walls of the locking section apart, causing at least some of the locking serrations to engage at least some of the anchoring serrations to lock the seal member in place.

4. In a well having a wellhead housing with a bore therethrough for supporting a casing hanger, the casing hanger having an exterior wall surface spaced inward from an interior wall surface in the bore, an improved means for sealing the wall surface between the casing hanger and the wellhead housing, comprising in combination:

a set of anchoring serrations having a saw-tooth shape with a selected pitch formed on one of the wall surfaces;

a seal member, having a seal section which is compressed between the wall surfaces below the anchoring serrations;

a locking section on the seal member located above the seal section, the locking section having at least one wall extending upward from the seal section;

a split ring mounted to the locking section radially spaced from the wall of the locking section, the split ring having a wall;

a set of locking serrations having a saw-tooth shape of the same configuration as the anchoring serrations and formed on the wall of the split ring;

means including an energizing ring positioned for downward movement between the split ring and the wall of the locking section to move the split ring radially, causing at least some of the locking serrations to engage at least some of the anchoring serrations to lock the seal member in place.

5. In a well having a wellhead housing with a bore therethrough for supporting a casing hanger, the casing hanger having an exterior wall surface spaced inward from an interior wall surface in the bore, an improved means for sealing the wall surfaces between the casing hanger and the wellhead housing, comprising in combination:

a set of anchoring serrations having a saw-tooth shape with a selected pitch formed on each of the wall surfaces;

a seal member, having a seal section which is compressed between the wall surfaces below the anchoring serrations;

a locking section on the seal member located above the seal section, the locking section having inner and outer cylindrical walls radially spaced apart from each other, with at least one of the cylindrical walls comprising a split ring;

a set of locking serrations having a saw-tooth shape of the same configuration as the anchoring serrations and formed on each of the walls of the locking section;

means including an energizing ring for downward movement to urge the walls of the locking section apart, causing at least some of the locking serrations to engage at least some of the anchoring serrations to lock the seal member in place; and at least one slot extending through the each of the walls of the locking section to facilitate radial movement of the walls as the energizing ring moves downward.

6. In a well having a wellhead housing with a bore therethrough for supporting a casing hanger, the casing hanger having an exterior cylindrical wall surface spaced inward from an interior cylindrical wall surface in the bore, an improved means for sealing the wall surfaces between the casing hanger and the wellhead housing, comprising in combination:

a tapered seal surface formed below the cylindrical wall surface on the exterior of the casing hanger;

a plurality of serrations formed on one of the wall surfaces, each of the serrations having an inclined downward facing flank;

a seal member, having an elastomeric seal section of tapered configuration which is wedged between the tapered seal surface and the wall surface of the wellhead housing bore below the serrations;

a locking section on the seal member located above the seal section, the locking section having a serrated wall and a cylindrical wall radially separated from each other;

a plurality of serrations formed on the serrated wall, each of the serrations on the locking section having an inclined upward facing flank;

means including an energizing ring for downward movement to urge the walls of the locking section apart, causing at least some of the upward facing flanks to engage at least some of the downward facing flanks to lock the seal member in place;

at least one slot formed through the serrated wall to facilitate radial expansion of the serrated wall; and the serrated wall being constructed so as to deform an amount less than an amount required to permanently deform when urged apart by the energizing ring, so that when the energizing ring is pulled upward, the serrated wall will elastically disengage its serrations to facilitate retrieval of the packoff.

7. In a well having a wellhead housing with a bore therethrough for supporting a casing hanger, the casing hanger having an exterior wall surface spaced inward from an interior wall surface in the bore, an improved means for sealing the wall surfaces between the casing hanger and the wellhead housing, comprising in combination:

a set of anchoring serrations having a saw-tooth shape formed on at least one of the wall surfaces;

a seal member, having a seal section which is compressed between the wall surfaces below the anchoring serrations;

a locking section on the seal member extending upward from the seal section, the locking section having at least one wall extending upward from the seal section;

a split ring mounted to the locking section and spaced radially from the wall of the locking section;

a set of locking serrations having a saw-tooth shape of the same configuration as the anchoring serrations and formed on the split ring;

means including an energizing ring carried by the locking section for downward movement between the wall of the locking section and the split ring to urge the split ring radially against the anchoring serrations, causing at least some of the locking serrations to engage at least some of the anchoring serrations to lock the seal member in place; and the split ring being removable from the locking section to allow selection as to whether locking of the seal member to the anchoring serrations will occur.

* * * * *